US005526878A

United States Patent [19]

Duell et al.

[11] Patent Number: 5,526,878

[45] Date of Patent: Jun. 18, 1996

[54] STAGE CEMENTER WITH INTEGRAL INFLATION PACKER

[75] Inventors: Alan B. Duell; David D. Szarka, both of Duncan, Okla.

[73] Assignee: Halliburton Company, Duncan, Okla.

[21] Appl. No.: 384,729

[22] Filed: Feb. 6, 1995

[51] Int. Cl.[6] ..... E21B 33/12; E21B 33/13

[52] U.S. Cl. ..... 166/187; 166/319

[58] Field of Search ..... 166/187, 289, 166/154, 151, 184, 318, 332

[56] References Cited

U.S. PATENT DOCUMENTS

| | | | |
|---|---|---|---|
| 3,053,322 | 9/1962 | Kline | 166/318 X |
| 3,148,731 | 9/1964 | Holden | 166/318 X |
| 3,412,805 | 11/1968 | Gribbin et al. | 166/184 |
| 3,524,503 | 8/1970 | Baker | 166/289 |
| 3,527,299 | 9/1970 | Lewis | 166/184 |
| 3,768,556 | 10/1973 | Baker | 166/154 |
| 3,908,769 | 9/1975 | Schuyf et al. | 166/184 X |
| 3,948,322 | 4/1976 | Baker | 166/289 |
| 4,421,165 | 12/1983 | Szarka | 166/151 |
| 5,024,273 | 6/1991 | Coone et al. | 166/187 X |
| 5,038,862 | 8/1991 | Giroux et al. | 166/289 |
| 5,044,444 | 9/1991 | Coronado | 166/187 X |
| 5,109,925 | 5/1992 | Stepp et al. | 166/184 |
| 5,178,216 | 1/1993 | Giroux et al. | 166/242 |
| 5,186,258 | 2/1993 | Wood et al. | 166/187 X |
| 5,279,370 | 1/1994 | Brandell et al. | 166/386 |
| 5,314,015 | 5/1994 | Streich et al. | 166/184 |
| 5,348,089 | 9/1994 | Brandell et al. | 166/154 |

*Primary Examiner*—Frank S. Tsay

*Attorney, Agent, or Firm*—Craig W. Roddy; Stephen R. Christian; Neal R. Kennedy

[57] ABSTRACT

A stage cementer with integral inflation packer. The apparatus comprises a mandrel with an external closing sleeve and an operating sleeve interlocked therewith. Below the operating sleeve is an opening sleeve. The opening sleeve is mechanically actuated by a pump-down plug to actuate the opening sleeve and thereby to allow inflation of a packer portion disposed around said mandrel. An anchor ring is disposed in said mandrel and engaged therewith by a retainer ring. The anchor ring limits movement of the opening sleeve, and a shallow portion of a groove prevents radially inward movement of the retainer ring so that the anchor ring remains lockingly engaged with the mandrel. A back check valve prevents the packer from deflating. When the packer portion is inflated, a packer shoe slidably moves about an outer surface of the closure sleeve. After the packer portion is inflated, additional pressure is applied which ruptures a rupture disc to open a port to the well annulus above the packer portion. Cementing may be carried out through this port, and after the cementing operation, a plug engages the operating sleeve to move the operating sleeve and the external closure sleeve, thereby closing the cementing port.

22 Claims, 3 Drawing Sheets

STAGE CEMENTER WITH INTEGRAL INFLATION PACKER

BACKGROUND OF THE INVENTION

1. Field of the Invention

This invention relates to apparatus used in downhole cementing of well casing, and more particularly, to a stage cementer with an integral packer and an improved means for retaining internal seats therein.

2. Description of the Prior Art

In preparing oil well boreholes for oil and/or gas production, a most important step involves the process of cementing. Basically, oil well cementing is the process of mixing a cement-water slurry and pumping it down through steel casing to critical points located in the annulus around the casing, in the open hole below, or in fractured formations.

Cementing a well protects possible production zones behind the casing wall against salt water flow and protects the casing against corrosion from subsurface mineral waters and electrolysis from outside. Cementing also eliminates the danger of fresh drinking water and recreational water supply strata from being contaminated by oil or salt water flow through the borehole from formations containing these substances. It further prevents oil well blowouts and fires caused by high pressure gas zones behind the casing and prevents collapse of the casing from high external pressures which can build up underground.

A cementing operation for protection against the above-described downhole condition is called primary cementing. Secondary cementing includes the cementing processes used in a well during its productive life, such as remedial cementing and repairs to existing cemented areas. The present invention is generally useful in both primary and secondary or remedial cementing. In the early days of oilfield production, when wells were all relatively shallow, cementing was accomplished by flowing the cement slurry down the casing and back up the outside of the casing in the annulus between the casing and the borehole wall.

As wells were drilled deeper and deeper to locate petroleum reservoirs, it became difficult to successfully cement the entire well from the bottom of the casing, and, therefore, multiple stage cementing was developed to allow the annulus to be cemented in separate stages, beginning at the bottom of the well and working upwardly.

Multiple stage cementing is achieved by placing cementing tools, which are primary valved ports, in the casing or between joints of casing at one or more locations in the borehole; flowing cement through the bottom of the casing, up the annulus to the lowest cementing tool in the well; closing off the bottom and opening the cementing tool; and then flowing cement through the cementing tool up the annulus to the upper stage, and repeating this process until all of the stage of cementing are completed.

Some prior art cementing tools used for multi-stage cementing have two internal sleeves, both of which are shear-pinned initially in an upper position, closing the cementing ports in the tool. To open the cementing ports, a plug is flowed down the casing and seated on the lower valve. Fluid pressure is then increased in the casing until sufficient force is developed on the plug and sleeve to shear the shear pins and move the lower sleeve to the position uncovering the cementing ports. Cement is then flowed down the casing and out the ports into the annulus. When the predetermined desired amount of cement is flowed into the annulus, another plug is placed in the casing behind the cement and flowed down the casing to seat on the upper valve. The pressure is increased on the second plug until the shear pins holding it are severed and the upper sleeve is moved down to close the cementing ports. One such cementing tool of this type is disclosed in Baker U.S. Pat. No. 3,768,556, assigned to the assignee of the present invention.

One improvement on the Baker '556 device is found in Jessup et al. U.S. Pat. No. 4,246,968, and also assigned to the assignee of the present invention. The Jessup et al. '968 patent discloses a device similar to that of the Baker '556 patent, except it has added a protective sleeve which covers some of the internal areas of the tool which are otherwise exposed when the internal sleeve is moved downwardly to close the port. This protective sleeve prevents other tools, which may be later run through the cementing tool, from hanging up on the inner bore of the cementing tool.

Another approach which has been utilized for cementing tools is to locate the closure sleeve outside the housing of the tool. One such line of tools is distributed by the Bakerline Division of Baker Oil Tools, Inc., known as the Bakerline Model "J" and Model "G" stage cementing collars. These closure sleeves have a differential area defined thereon and are hydraulically actuated in response to internal casing pressure which is communicated with the sleeves by movement of an internal operating sleeve to uncover a fluid pressure communication port.

An external sleeve cementing tool which uses a mechanical inner locking means between an inner operating sleeve and an outer closure sleeve is disclosed in Giroux et al. U.S. Pat. No. 5,038,862, assigned to the assignee of the present invention. This external sleeve cementing tool is particularly useful in completing stage cementing of slim hole oil and gas wells. Slim hole completions involve using casing inside relative small hole sizes to reduce the cost of drilling the well. In other words, the well annulus between the borehole and the casing is relatively small.

There are cementing applications which necessitate the sealing off of the annulus between the casing string and the wall of the borehole and one or more positions along the length of the casing string. An example of such an application is when it is desired to achieve cementing between a high pressure gas zone and a lost circulation zone penetrated by the borehole. Another application is when it is desired to achieve cementing above a lost circulation zone penetrated by the borehole. A third application occurs when the formation pressure of an intermediate zone penetrated by the borehole is greater than the hydrostatic head of the cement to be placed in the annulus thereabove. Still another application occurs when a second stage of cement is to be placed at a distant point up the hole from the top of the first stage of cement, and a packer is required to further support the cement column in the annulus. A further example of an application for employment of the cementing packer occurs when it is desired to achieve full hole cementing of slotted or perforated liners.

An example of such an inflation packer for cementing is the multi-stage inflatable packer disclosed in Baker U.S. Pat. No. 3,948,322, assigned to the assignee of the present invention. In this device, an open plug is dropped into the casing string and pumped down to actuate an opening sleeve to allow inflation of the packer element. A back check valve prevents the packer from deflating. After the packer is inflated, additional pressure is applied which moves an annular valve member to open a port in the well annulus above the inflated packer element. In a later version of this apparatus, a thin walled secondary opening sleeve is sheared to open this port.

The secondary opening sleeve, being essentially a thin walled mandrel, is difficult to manufacture. Further, when the tool is positioned in the wellbore, there may be some bending of the tool which can cause the annular valve member or secondary opening sleeve to bind and not open as desired. This problem is addressed in Stepp et al. U.S. Pat. No. 5,109,925, also assigned to the assignee of the present invention, in which the annular valve member or secondary opening sleeve is replaced by a secondary rupture disc which is designed to burst or rupture at the predetermined pressure.

A stage cementer and inflation packer which combines the advantages of the external sleeve cementing tool of Giroux et al. '862 with the inflation packer of Stepp et al. '925 is found in Streich et al. U.S. Pat. No. 5,314,015, another patent assigned to the assignee of the present invention. Thus, Streich et al. provides an apparatus which is well adapted for use in slim hole completions and those applications which necessitate the sealing off of the annulus between the casing string and the borehole, while eliminating the binding problems which can result due to slight bending of the tool. The Streich et al. apparatus has the disadvantage of being relatively expensive to manufacture due in part to the need to attach a long packer to the cementer by means of a specially designed coupling. The present invention solves this problem by providing an external cementer configuration with a lengthened mandrel such that the packer element can be assembled directly onto the mandrel. The top end of the packer element overlaps with a closing sleeve to allow a path for fluid to enter the packer from the cementing portion and thereby inflate the packer element. This design allows for a reduced number of parts, simpler assembly, and reduced manufacturing costs relative to the previous external sleeve designs. As a result, the present invention results in an apparatus which is much shorter than the device of Streich et al. and therefore is less expensive to package, transport and handle.

Another possible disadvantage of the previous device of Streich et al. is that the seat retainer therein may not hold its position because the lock ring used to hold the seat retainer in place may slide out of its groove. This is generally undesirable, and the present invention incorporates an improvement in the seat retainer that prevents the lock ring from slipping out of its groove. This has the additional advantage that high pressures may be applied on top of the cementer closing plugs in order to pressure test the casing without movement of the seat retainer which was not possible with the previous design.

SUMMARY OF THE INVENTION

The present invention is a stage cementer with an integral inflation packer and an improved means for retaining or locking an internal seat, such as an anchor ring, in the apparatus. The apparatus is used in the downhole cementing of well casing.

The stage cementer apparatus comprises a mandrel having an inner passage defined therethrough and having an outer surface, an inflatable packer portion disposed around the outer surface of the mandrel, an inflation passageway means for providing communication between the inner passage in the mandrel and the packing means when open. The inflation passageway means comprises an annulus defined between the packer portion and the mandrel. The apparatus further comprises an opening sleeve slidably received in the mandrel and movable between a closed position wherein the inflation passageway means is closed and an open position wherein the inflation passageway means is open, pressure relief means upstream of the packer portion for opening in response to a predetermined pressure after inflation of the packer portion and thereby placing the inner passage in the mandrel in communication with a well annulus, and an outer closure sleeve slidably received about the outer surface of the mandrel and movable between an open position wherein the pressure relief means provides communication between the inner passage and the well annulus when the pressure relief means is opened and a closed position wherein communication between the inner passage and the well annulus is prevented. The stage cementer additionally comprises an inner operating sleeve slidably received in the mandrel and movable between first and second positions relative to the mandrel, and inner locking means operably associated with both the operating sleeve and the closure sleeve for transferring a closing force from the operating sleeve to the closure sleeve and thereby moving the closure sleeve to its closed position as the operating sleeve moves from its first position to its second position.

The inflation passageway means also comprises a port defined through a wall of the mandrel. This port is in communication with the pressure relief means.

The pressure relief means preferably comprises rupture means for rupturing in response to the predetermined pressure, and in one embodiment, the rupture means comprises a rupture disc adapted for rupturing outwardly. The pressure relief means is preferably disposed in a port defined in the outer closure sleeve.

The packer portion of the apparatus comprises a packer shoe slidably disposed around a portion of the outer closure sleeve. A guide ring is disposed on the mandrel for guiding the packer shoe as the packer shoe is moved relative to the mandrel. The packer portion further comprises another packer shoe lockingly engaged with the mandrel.

A guide ring disposed on the mandrel is adapted for guiding the slidable packer shoe as the slidable packer shoe is moved relative to the mandrel. A check valve means disposed between the slidable packer shoe and the mandrel allows movement of fluid into the packer portion for inflation thereof while preventing deflation of the packer portion. A retaining means disposed within the slidable packer shoe is provided for preventing relative movement between the check valve means and the slidable packer shoe.

The present invention may also be described as a cementing tool apparatus comprising a mandrel having an inner passage defined therethrough and having an outer surface, an opening sleeve slidably received in the mandrel and movable between a closed position and an open position, passageway means adapted for communication with the inner passage when the opening sleeve is in the open position, an anchor ring disposed in the mandrel, a retainer ring for engaging the anchor ring and the mandrel, and locking means for locking the anchor ring and thereby limiting movement of the opening sleeve when the opening sleeve is moved to the open position thereof such that the anchor ring is locked with respect to the mandrel and disengagement of the retainer ring between the anchor ring and the mandrel is prevented.

The locking means may be characterized by the mandrel defining a mandrel groove thereon and the anchor ring defining a ring groove thereon with the ring groove comprising a deep portion and a shallow portion. The deep portion is sized such that when the retainer ring is aligned with the deep portion, the anchor ring may be moved longitudinally in the mandrel so that the retainer ring may be aligned with the mandrel groove and engaged therewith. The shallow portion is sized such that when the retainer ring is aligned with the shallow portion, radially inward movement of the retainer ring is prevented whereby further longitudinal movement of the anchor ring is also prevented. The shallow portion is preferably located longitudinally above the deep portion.

Numerous objects and advantages of the present invention will become apparent when the following detailed description of the preferred embodiment is read in conjunction with the drawings which illustrate such embodiment.

DESCRIPTION OF THE PREFERRED EMBODIMENT

Figure 1A:
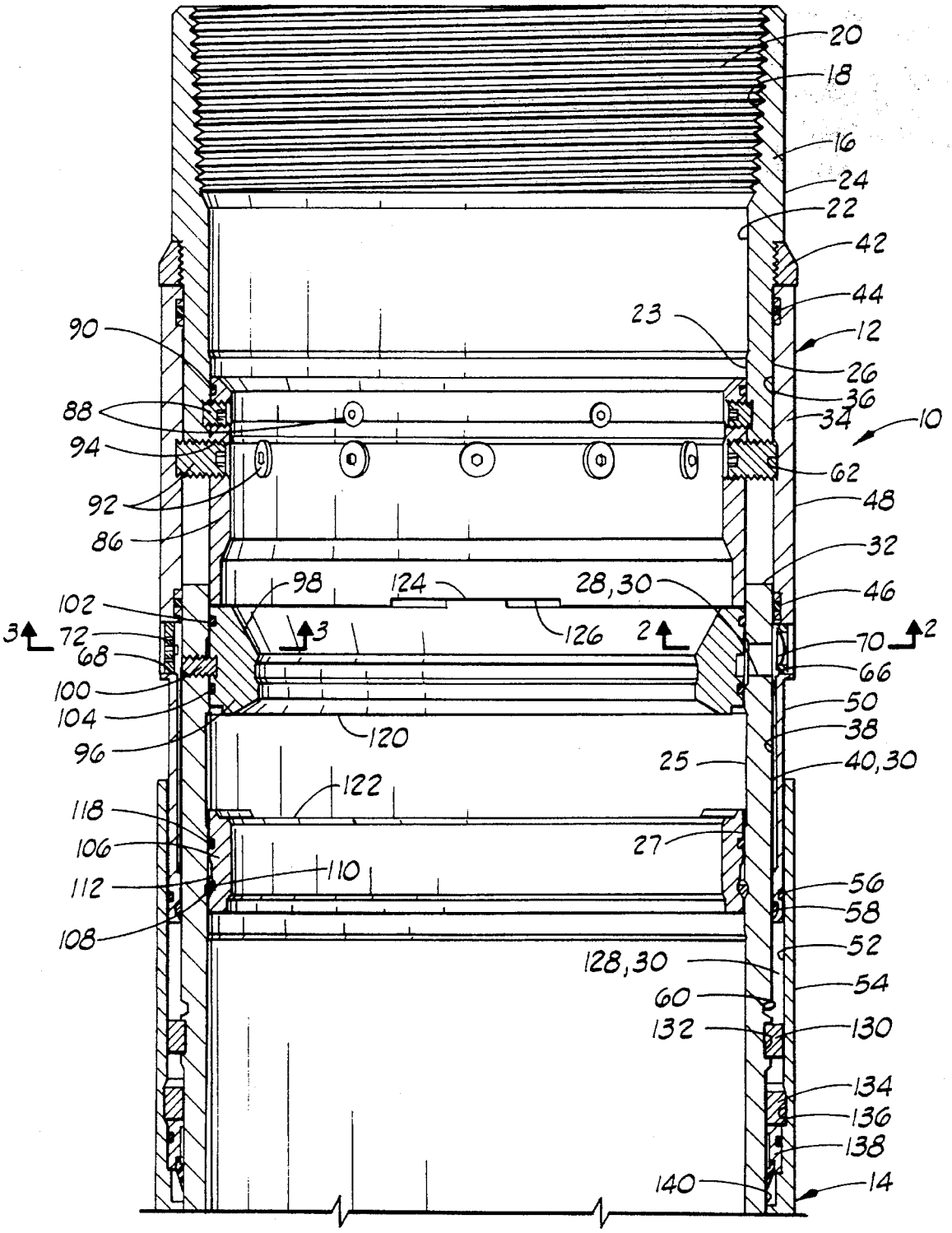
FIGS. 1A and 1B show a longitudinal cross section of the stage cementer with inflation packer apparatus of the present invention.
Figure 1B:
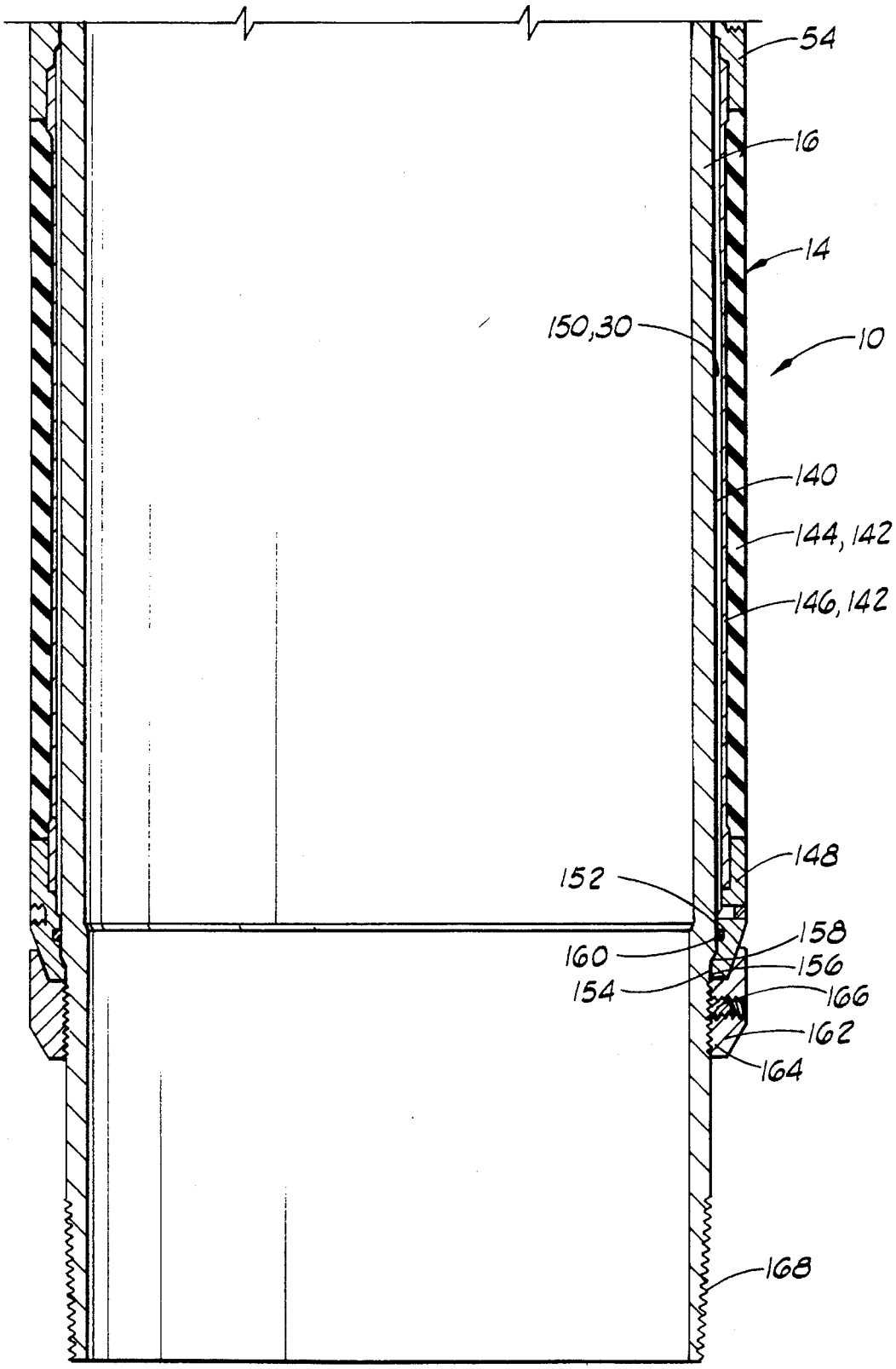

Referring now to the drawings, and more particularly to FIGS. 1A–1B, the stage cementer with integral packer of apparatus of the present invention is shown and generally designated by the numeral 10. Apparatus 10 generally comprises an upper, cementer portion 12 and a lower, packer portion 14.

Apparatus 10 includes a substantially tubular mandrel 16 which extends through both cementer portion 12 and packer portion 14. Mandrel 16 has an internally threaded surface 18 at the upper end thereof adapted for connection to a casing string. Mandrel 16 defines an inner passage 20 therein, at least partially defined by a first bore 22, a slightly smaller second bore 23, a third bore 25 and a fourth bore 27 in the mandrel.

Mandrel 16 has a first outer surface 24 and a slightly smaller second outer surface 26 below the first outer surface. At least one transversely disposed mandrel port 28 is defined through the wall of mandrel 16 and extends between bore 22 and second outer surface 26. As will be further discussed herein, mandrel port 28 is used as an inflation port forming part of an inflation passageway means 30 and as a cementing port. As will be further described herein, inflation passageway means 30 provides communication between inner passage 20 in mandrel 16 and packer portion 14.

Also defined in mandrel 16 are a plurality of longitudinally extending slots 32. Slots 32 are preferably disposed above mandrel port 28.

Apparatus 10 includes an outer, external closing sleeve 34 having a first bore 36 which is concentrically, closely, slidably received about second outer surface 26 of mandrel 16. Closure sleeve 34 also has a slightly larger second bore 38 therein such that an annulus 40 is defined between second bore 38 and second outer surface 26 of mandrel 16. As will be further described herein, annulus 40 also forms a portion of inflation passageway means 30 and is in communication with mandrel port 28.

Closure sleeve 34 is movable relative to mandrel 16 between an open position, as seen in FIG. 1A. and a closed position wherein mandrel port 28 is covered and closed by the closure sleeve, as will be further described herein.

A support ring 42 is threadingly engaged with mandrel 16 above closure sleeve 34 and acts as an upper stop for the closure sleeve.

A sealing means, such as an upper seal 44 and a lower seal 46, provides sealing engagement between closure sleeve 34 and second outer surface 26 of mandrel 16. Upper seal 44 is always positioned above slots 32. In the open position shown in FIG. 1A, lower seal 46 is disposed between slots 32 and mandrel port 28.

Closure sleeve 34 has a first outer surface 48 and a smaller second outer surface 50 below the first outer surface. At least a portion of second outer surface 50 is slidably received within first bore 52 defined in an upper packer shoe 54 of packer portion 14. Thus, upper packer shoe 54 of packer portion 14 acts as a housing for slidably receiving the lower end of closure sleeve 34 of cementer portion 12, and it may be said that cementer portion 12 and packer portion 14 overlap.

A sealing means, such as O-ring 56, provides sealing engagement between closure sleeve 34 and upper packer shoe 54.

A lock ring 58 is carried by the lower end of closure sleeve 34 below O-ring 56. Lock ring 58 is adapted for lockingly engaging an undercut groove 60 on mandrel 16 so that, when closure sleeve 34 is moved to its closed position, lock ring 58 will lock the closure sleeve in this position.

An annular groove 62 is defined in closure sleeve 34 and generally faces inwardly toward slots 32.

Closure sleeve 34 also defines a transversely disposed first threaded sleeve port 66 and a second threaded sleeve port 68. First threaded sleeve port 66 is in communication with mandrel port 28, and as will be further described herein, acts as a pressure relief in cementing the port. First and second sleeve ports 66 and 68 will be seen to be in communication with annulus 40. A pressure relief means 70 is threadingly engaged with first sleeve port 66, and a pressure equalizing means 72 is threadingly engaged with second sleeve port 68.

Figure 2:
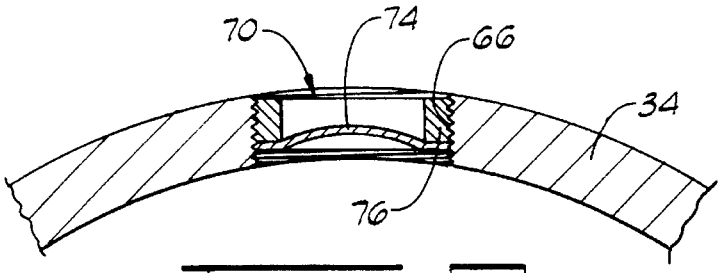
FIG. 2 is a partial cross section taken along lines 2—2 in FIG. 1A.

Referring now to FIG. 2, a preferred embodiment of pressure relief means 70 is illustrated as a rupture means characterized by a rupture disc 74 which is attached to a rupture disc retainer 76 by means such as braising or welding. Rupture disc retainer 76 is threaded into first sleeve port 66.

Figure 3:
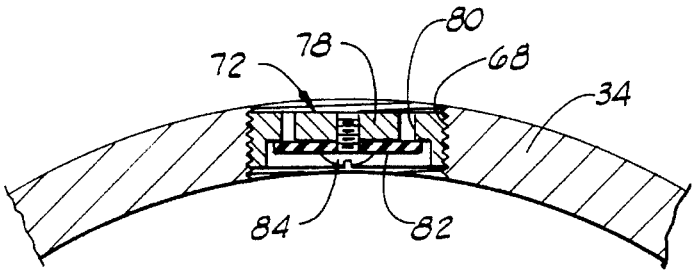
FIG. 3 is a partial cross section taken along lines 3—3 in FIG. 1A.

Referring now to FIG. 3, pressure equalizing means 72 is characterized by a back check valve assembly 72. Back check valve assembly 72 includes a valve seat 78 which has a plurality of openings 80 defined therethrough and is threadingly engaged with second sleeve port 68. A flexible valve member 82 is attached to the inside of valve seat 78 by a fastening means, such as a screw 84. It will be seen by those skilled in the art that due to the flexibility of valve member 82, fluid may flow inwardly through valve equalizing means 72 but outward flow is prevented. This prevents an undesired pressure differential across rupture disc 74 in pressure relief means 70 as the tool is run into the well bore. That is, pressure equalizing means 72 insures that the pressure on both sides of rupture disc 74 is equalized and rupture disc 74 will not be ruptured inwardly by pressure from the well bore.

Referring again to FIG. 1A, apparatus 10 includes an inner operating sleeve 86 which is slidably received in second bore 23 in mandrel 16. Operating sleeve 86 is slidable between the first position relative to mandrel 16, as seen in FIG. 1A, and a second position corresponding to the closed position of closure sleeve 34, as will be further described herein.

A plurality of shear pins 88 initially hold operating sleeve 86 in its first position. A sealing means, such as O-ring 90, provides sealing engagement between operating sleeve 86 and mandrel 16.

A plurality of pins 92 extend through slots 32 in mandrel 16 and are fixably connected to operating sleeve 86 and closure sleeve 34 for common longitudinal movement relative to mandrel 16 throughout the entire movement of operating sleeve 86 from its first position to its second position. Since pins 92 fixedly connect operating sleeve 86 to closure sleeve 34, there is no lost longitudinal motion of operating sleeve 86 relative to closure sleeve 34 as the operating sleeve moves downwardly to close mandrel port 28 with closure sleeve 34.

Each pin 92 is threadingly engaged with a threaded opening 94 in operating sleeve 86 and extends through slot 32 in mandrel 16 to tightly engage groove 62 in closure sleeve 34.

Pins 92 and their engagement with operating sleeve 86 and closure sleeve 34 may all be referred to as an interlocking means, and more particularly to a mechanical means, extending through slots 32 and operably associated with both the operating sleeve and the closure sleeve for transferring a closing force from the operating sleeve to the closure sleeve, and thereby moving closure sleeve 34 to its closed position as operating sleeve 86 moves from its first position and its second position.

Pins 92 also serve to hold operating sleeve 86 so that it will not rotate as operating sleeve 86 is later drilled out of mandrel 16 after the cementing job is completed.

Apparatus 10 further includes an internal lower opening sleeve 96 slidably received in second bore 23 of mandrel 16 below operating sleeve 86. Opening sleeve 96 is slidable between a closed position as shown in FIG. 1A covering mandrel port 28 and an open position wherein mandrel port 28 is uncovered by opening sleeve 96 as the opening sleeve moves downwardly relative to mandrel 16. It is noted that when opening sleeve 96 is in its closed position as shown in FIG. 1A, operating sleeve 86 is simultaneously in its first position, and inner passage 20 of mandrel 16 is in fluid pressure communication with bore 36 of closure sleeve 34 between seals 44 and 46. This is because there is no seal between the lower end of operating sleeve 86 and mandrel 16.

Opening sleeve 96 is a plug operated sleeve having an annular seat 98 defined on its upper end which is constructed for engagement by a pump-down or free-fall plug (not shown) of a kind known in the art. A plurality of shear pins 100 initially hold opening sleeve 96 in its closed position. A sealing means, such as upper and lower O-rings 102 and 104, provides sealing engagement between opening sleeve 96 and bore 23 of mandrel 16 above and below mandrel port 28, respectively, when the opening sleeve is in its closed position.

Figure 4:
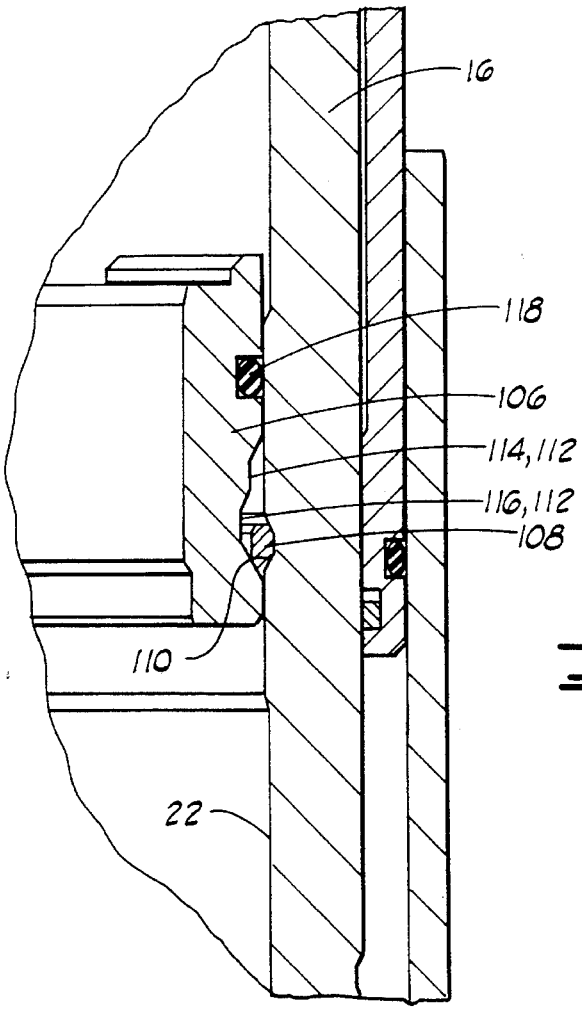
FIG. 4 is an enlarged detail showing an improved seat retainer which prevents the seat retainer lock ring from slipping out of its groove.

An anchor ring 106 is disposed in fourth bore 27 of mandrel 16 and is spaced below opening sleeve 96 when the opening sleeve is in its closed position. Anchor ring 106 is locked into position by a retainer ring 108 of a kind known in the art such as disclosed in U.S. Pat. No. 5,178,216 to Giroux and Brandell, assigned to the assignee of the present invention. Referring now to FIG. 4, retainer ring 108 is disposed in a retainer ring groove or mandrel groove 110 in fourth bore 27 of mandrel 16. Retainer ring 108 is radially outwardly biased by natural spring resiliency of the retainer ring.

At least a portion of retainer ring 108 is also disposed in a ring groove 112 defined in the outer surface of anchor ring 106. Groove 112 has a relatively shallow upper portion 114 and a relatively deeper lower portion 116. When anchor ring 106 is disposed in mandrel 16, retainer ring 108 is compressed so that it fits in deeper lower portion 116 of groove 112. Lower portion 116 of groove 112 is dimensioned so that retainer ring 108 may be disposed therein such that anchor ring 106 may be passed downwardly through bore 22 in mandrel 16 without interference. When lower portion 116 of groove 112 is aligned with retainer ring groove 110 in mandrel 16, retainer ring 108 will spring outwardly to engage retainer ring groove 110.

As will be further described herein, if anchor ring 106 is moved downwardly with respect to retainer ring 108, shallow upper portion 114 of groove 112 is aligned with retainer ring 108. In this position, retainer ring 108 cannot be deflected radially inwardly because the inside diameter thereof is preferably just large enough to fit in shallow upper portion 114 of groove 112. Thus, as downward force is applied to anchor ring 106, retainer ring 108 cannot be forced out of retainer ring groove 110. This interaction of retainer ring 108 with shallow upper portion 114 of groove 112 represents an improved seat retaining means for retaining anchor ring 106 in mandrel 116.

A sealing means, such as O-ring 118, provides sealing engagement between anchor ring 106 and mandrel 16.

Referring again to FIG. 1A, when opening sleeve 96 is moved to its open position, as further described herein, it moves downwardly until it abuts anchor ring 106. A lower end 120 of opening sleeve 96 acts as a lug which is received within an upwardly facing recess 122 on anchor ring 106 when the opening sleeve is moved to its closed position. This prevents opening sleeve 96 from rotating relative to anchor ring 106 in mandrel 16 at a later time when the internal components are drilled out of mandrel 16. Similarly, a lug 124 on the upper end of opening sleeve 96 is received within a downwardly facing recess 126 on the lower end of operating sleeve 86 when the opening sleeve is in its open position and the operating sleeve is moved to its second position. This prevents operating sleeve 86 from rotating relative to opening sleeve 96 in mandrel 16 at a later time when the internal components are drilled out of the mandrel.

Also during drilling out, anchor ring 106 is prevented from rotating by wedging action of retainer ring 108 in groove 112. This action is described in the previously mentioned U.S. Pat. No. 5,178,216.

Below lock ring 58, mandrel 16 and upper packer shoe 54 define an annular passageway 128 therebetween which will be seen to be part of inflation passageway means 30. A stop ring 130 is disposed in annular passageway 128 and is engaged with a groove 132 on the outer surface of mandrel 16. Stop ring 130 is an inwardly biased retainer ring and is adapted for sliding engagement within first bore 52 of upper packer shoe 54 as the upper packer shoe moves downwardly as hereinafter described. Fluid is free to flow downwardly through annular passageway 128 past stop ring 130.

A check valve retainer ring 134 is disposed in annular passageway means 128 and is engaged with a groove 136 on the inside of upper packer shoe 54. Check valve retainer ring 134 is a radially outwardly biased retainer ring and is adapted to allow fluid flow therepast through annular passageway 128.

A check valve 138 is disposed in annular passageway 128 adjacent to check valve retainer ring 134. Check valve 138 sealingly engages outer surface 140 of mandrel 16. Check valve 138 is of a kind known in the art and allows fluid flow downwardly through annular passageway 128 while preventing upward fluid flow.

Referring now to FIG. 1B, packer portion 14 of apparatus 10 further comprises a metal bladder packer 142 which includes an outer, elastomeric sealing element 144 and an inner, metal element 146. Sealing element 144 and metal element 146 are attached at their upper ends to upper packer shoe 54 in a manner known in the art and at their lower ends to a lower packer shoe 148. An annulus 150 is defined between metal element 146 and outer surface 140 of mandrel 16. Annulus 150 forms a portion of inflation passageway means 30.

Lower packer shoe 148 has a first bore 152 therein which generally faces outer surface 140 of mandrel 16 and a smaller second bore 154 which faces another, smaller outer surface 156 of mandrel 16. Upward movement of lower packer shoe 148 with respect to mandrel 16 is prevented by a shoulder 158 on the mandrel which extends between outer surfaces 140 and 156.

A sealing means, such as O-ring 160, provides sealing engagement between lower packer shoe 148 and mandrel 16.

A packer backup ring 162 is attached to mandrel 16 at threaded connection 164. Backup ring 162 is adapted to engage lower packer shoe 148 and prevent downward movement thereof with respect to mandrel 16. A set screw 166 prevents undesired rotation of backup ring 162.

Below packer portion 14, mandrel 16 has a threaded outer surface 168 which is adapted for connection to casing string below apparatus 10 as desired.

OPERATION OF THE APPARATUS

Packer 10 is made up as part of the casing string which is run into the well bore in a manner known in the art. Apparatus 10 is in the configuration shown in FIGS. 1A and 1B when run into the well bore.

As apparatus 10 is run into the well bore, the pressure in the well annulus and the pressure in annulus 40 in the tool is equalized through pressure equalizing means 72. Fluid in the well bore will pass through openings 80 in valve body 78 and deflect valve member 82 inwardly (see FIG. 3). This prevents premature inward rupturing of rupture disc 74 (see FIG. 2).

Cementing of the first or bottom stage below apparatus 10 is carried out in a manner known in the art. This places cement between the casing and the well bore at a location below apparatus 10.

After the first stage cementing operation is completed, opening sleeve 96 is actuated. This is accomplished by dropping into the casing a pump-down or free-fall opening plug (not shown) of a kind known in the art. The opening plug engages annular seat 98 on opening sleeve 96.

Pressure is then applied to the casing which forces the opening plug against opening sleeve 96, thereby shearing shear pins 100 and moving opening sleeve 96 downwardly from its closed position until lower end 120 thereof contacts anchor ring 106. This places opening sleeve 96 in its open position, and it will be seen by those skilled in the art, that mandrel port 28 is thus opened and placed in communication with inner passage 20 in mandrel 16.

When opening sleeve 96 engages anchor ring 106, anchor ring 106 will be moved downwardly slightly so that shallow upper portion 114 of groove 112 in anchor ring 106 is aligned with retainer ring 108, as previously described. When in this position, retainer ring 108 cannot be deflected radially inwardly no matter how much force is applied to anchor ring 106. Thus, anchor ring 106 cannot become disengaged, as is possible with prior art devices of this type.

As casing pressure is increased, fluid passes through inflation passageway means 30 to inflatable packer portion 14. That is, fluid passes from inner passage 20 through mandrel port 28 into annulus 40, then through annular passageway 128 to check valve 138. The fluid flows past check valve 138 into annulus 150 inside packer portion 14. Check valve 138 insures that there is no back flow out of inflatable packer portion 14. As bladder 142 inflates, upper packer shoe 54 slides downwardly with respect to closing sleeve 34 and mandrel 16, allowing sealing element 144 to be brought into sealing engagement with the well bore.

When pressure in the casing, and thus in inner passage 20 and inflation passageway means 30, reaches a predetermined level, rupture disc 74 of pressure relief means 70 will rupture outwardly. It will be seen that this places first sleeve port 66 in closure sleeve 34 and mandrel port 28 in communication with the well annulus. Then cement for the second stage cementing can be pumped down the casing with the displacing fluids located therebelow being circulated through aligned ports 28 and 66 and back up the well annulus. A bottom cementing plug (not shown) may be run below the cement, and a top cementing plug (not shown) is run at the upper extremity of the cement, in a manner known in the art.

The bottom plug, if any, will seat against operating sleeve 86, and further pressure applied to the cement column will rupture a rupture disc in the bottom cementing plug. The cement will then flow through the bottom cementing plug and through aligned ports 28 and 66 and upwardly through the well annulus.

When the top cementing plug seats against the bottom cementing plug, the second stage of cementing is terminated. Further pressure applied to the casing causes the top and bottom cementing plugs to bear against operating sleeve 86, forcing the operating sleeve downwardly from its first position to its second position and shearing shear pins 88. Because of the mechanical interlocking by pins 92 between operating sleeve 86 and closure sleeve 34, closure sleeve 34 is moved downwardly from its open position to its closed position as operating sleeve 86 is moved downwardly from its first to its second position. As this occurs, lower seal 46 in closure sleeve 34 is moved below mandrel port 28, thus sealingly separating mandrel port 30 from first sleeve port 66. The interaction between lock ring 58 and groove 60 in mandrel 16 locks closure sleeve 34 in the closed position.

It will be seen by those skilled in the art that fluid may then no longer flow through mandrel port 28 and out first sleeve port 66 into the well annulus. Second outer surface 50 on closure sleeve 34 slides downwardly within upper packer shoe 54. Downward movement of operating sleeve 86 and closure sleeve 34 stops when the lower end of operating sleeve 86 engages the top of opening sleeve 96 and the lower end of closure sleeve 34 contacts stop ring 130.

Subsequent to this cementing operation, the upper and lower cementing plugs, operating sleeve 86, opening sleeve 96, and anchor ring 106 can all be drilled out of mandrel 16 leaving a smooth bore through apparatus 10. The components to be drilled out may be made of easily drillable material, such as aluminum. Since all of the components are non-rotatably locked to each other and to mandrel 16, as previously described, drilling out of the components is further aided.

It can be seen, therefore, that the stage cementer with integral inflation packer apparatus of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A cementing tool apparatus for use in a well bore, said apparatus comprising:

a mandrel having an inner passage defined therethrough and having an outer surface;

an inflatable packer portion disposed around said outer surface of said mandrel;

inflation passageway means for providing communication between said inner passage in said mandrel and said packer portion when opened, said inflation passageway means comprising an annulus defined between said packer portion and said mandrel;

an opening sleeve slidably received in said inner passage of said mandrel and movable between a closed position wherein said inflation passageway means is closed and an open position wherein said inflation passageway means is open;

pressure relief means upstream of said packer portion for opening in response to a predetermined pressure after inflation of said packer portion and thereby placing said inner passage in said mandrel in communication with the well bore;

an outer closure sleeve slidably received about said outer surface of said mandrel proximate said packer portion and movable between an open position wherein said pressure relief means provides communication between said inner passage and the well bore when said pressure relief means is opened and a closed position wherein communication between said inner passage and the well bore is prevented;

wherein said packer portion comprises a packer shoe slidably disposed around a portion of said outer closure sleeve; and inner locking means for transferring a closing force from said operating sleeve to said closure sleeve and thereby moving said closure sleeve to its closed position as said operating sleeve moves from its first position to its second position.

2. The apparatus of claim 1 wherein said inflation passageway means comprises a port defined through a wall of said mandrel.

3. The apparatus of claim 2 wherein said port is in communication with said pressure relief means.

4. The apparatus of claim 1 wherein said pressure relief means comprises rupture means for rupturing in response to said predetermined pressure.

5. The apparatus of claim 4 wherein said rupture means comprises a rupture disc.

6. The apparatus of claim 1 wherein said pressure relief means is disposed in a port defined in said outer closure sleeve.

7. The apparatus of claim 1 further comprising a guide ring disposed on said mandrel for guiding said packer shoe as said packer shoe is moved relative to said mandrel.

8. The apparatus of claim 1 further comprising check valve means disposed between said packer shoe and said mandrel for allowing movement of fluid into said packer portion for inflation thereof while preventing deflation thereof.

9. The apparatus of claim 8 further comprising valve retaining means engaged with said packer shoe for preventing relative movement between said check valve means and said packer shoe.

10. The apparatus of claim 1 further comprising:

an anchor ring disposed in said mandrel adjacent to a mandrel groove defined in said mandrel, said anchor ring defining a ring groove therein having:

a shallow portion; and a relatively deeper portion; and a retainer ring disposed in said ring groove such that:

when said retainer ring is aligned with said deeper portion, said anchor ring may be moved longitudinally in said mandrel without interference of said retainer ring with said mandrel; and when said retainer ring is aligned with said shallow portion, radially inward movement of said retainer ring is prevented;

said retainer ring being outwardly biased such that it will engage said mandrel groove when aligned therewith.

11. The apparatus of claim 10 wherein movement of said opening sleeve is limited by engagement thereof with said anchor ring.

12. A cementing tool apparatus for use in a well bore, said apparatus comprising:

a mandrel having an inner passage defined therethrough and having an outer surface;

an opening sleeve slidably received in said inner passage of said mandrel and movable between a closed position and an open position;

passageway means adapted for communication with said inner passage when said opening sleeve is in said open position;

an anchor ring disposed in said mandrel;

a retainer ring for engaging said anchor ring and said mandrel;

locking means for locking said anchor ring and thereby limiting movement of said opening sleeve when said opening sleeve is moved to said open position such that said anchor ring is locked with respect to said mandrel and disengagement of said retainer ring between said anchor ring and said mandrel is prevented;

wherein said locking means is characterized by said mandrel defining a mandrel groove thereon, and said anchor ring defining a ring groove thereon;

wherein said ring groove comprises:

a deep portion such that when said retainer ring is aligned with said deep portion, said anchor ring may be moved longitudinally in said mandrel so that said retainer ring may be aligned with said mandrel groove and engaged therewith; and a shallow portion such that when said retainer ring is aligned with said shallow portion, radially inward movement of said retainer ring is prevented such that further longitudinal movement of said anchor ring is also prevented.

13. The apparatus of claim 12 further comprising a packer portion disposed around said outer surface of said mandrel, said packer portion being in communication with said passageway means.

14. The apparatus of claim 13 further comprising pressure relief means upstream of said packer portion for opening in response to a predetermined pressure after inflation of said packer portion and thereby placing said inner passage in said mandrel in communication with the well bore.

15. The apparatus of claim 12 further comprising:

an inflatable packer portion disposed around said outer surface of said mandrel;

an outer closure sleeve slidably received about said outer surface of said mandrel proximate said packer portion; and wherein said packer portion comprises a packer shoe slidably received about a portion of said outer closure sleeve.

16. The apparatus of claim 15 further comprising check valve means disposed between said mandrel and said packer shoe and adapted for movement with said packer shoe as said packer portion is inflated, for allowing movement of fluid to said packer portion while preventing fluid flow out of said packer portion.

17. The apparatus of claim 16 wherein said portion of said closure sleeve about which said packer shoe is slidably disposed is a reduced diameter portion of said closure sleeve.

18. The apparatus of claim 15 wherein said packer shoe is an upper packer shoe;

and further comprising a lower packer shoe lockingly engaged with said mandrel.

19. The apparatus of claim 15 wherein said packer portion comprises a bladder having an elastomeric outer packer element and an inner metal element.

20. A cementing tool apparatus for use in a well bore, said apparatus comprising:

a mandrel having an inner passage defined therethrough and having an outer surface;

an inflatable packer portion disposed around said outer surface of said mandrel;

inflation passageway means for providing communication between said inner passage in said mandrel and said packer portion when opened;

pressure relief means upstream of said packer portion for opening in response to a predetermined pressure after inflation of said packer portion and thereby placing said inner passage in said mandrel in communication with the well bore;

an outer closure sleeve slidably received about said outer surface of said mandrel proximate said packer portion and movable between an open position wherein said pressure relief means provides communication between said inner passage and the well bore when said pressure relief means is opened and a closed position wherein communication between said inner passage and the well bore is prevented; and wherein said packer portion comprises a packer shoe slidably disposed around a portion of said outer closure sleeve.

21. The apparatus of claim 20 further comprising a guide ring disposed on said mandrel for guiding said packer shoe as said packer shoe is moved relative to said mandrel.

22. The apparatus of claim 20 further comprising:

an anchor ring disposed in said mandrel adjacent to a mandrel groove defined in said mandrel, said anchor ring defining a ring groove therein having:

a shallow portion; and a relatively deeper portion; and a retainer ring disposed in said ring groove such that:

when said retainer ring is aligned with said deeper portion, said anchor ring may be moved longitudinally in said mandrel without interference of said retainer ring with said mandrel; and when said retainer ring is aligned with said shallow portion, radially inward movement of said retainer ring is prevented;

said retainer ring being outwardly biased such that it will engage said mandrel groove when aligned therewith.

* * * * *